US007469513B2

(12) United States Patent
Schipani et al.

(10) Patent No.: US 7,469,513 B2
(45) **Date of Patent: *Dec. 30, 2008**

(54) FOLDABLE SUPPORT STRUCTURE WITH LOCKING WALL MEMBERS AND HINGE LOCKS

(75) Inventors: Ralph L. Schipani, Edina, MN (US); Richard K. Strayer, Andover, MN (US); Mark Brauer, Minneapolis, MN (US)

(73) Assignee: Eagle Development Corporation, Minneapolis, MN (US)

( * ) Notice: Subject to any disclaimer, the term of this patent is extended or adjusted under 35 U.S.C. 154(b) by 873 days.

This patent is subject to a terminal disclaimer.

(21) Appl. No.: 10/649,338

(22) Filed: Aug. 27, 2003

(65) Prior Publication Data

US 2006/0010821 A1 Jan. 19, 2006

Related U.S. Application Data

(63) Continuation-in-part of application No. 10/186,285, filed on Jun. 28, 2002, now Pat. No. 6,715,255.

(51) Int. Cl.
*E04H 12/00* (2006.01)

(52) U.S. Cl. ..... 52/648.1; 52/649.5; 52/646

(58) Field of Classification Search ..... 52/646, 52/645, 637, 648.1, 649.5; 211/199; 403/49, 403/72

See application file for complete search history.

(56) References Cited

U.S. PATENT DOCUMENTS

| | | | | |
|---|---|---|---|---|
| 1,140,448 | A | | 5/1915 | Ellinger |
| 2,987,148 | A | | 6/1961 | Millard |
| 3,011,586 | A | * | 12/1961 | Harvey, Jr. ..... 182/115 |
| 3,908,564 | A | | 9/1975 | Miller et al. |
| 4,280,310 | A | | 7/1981 | Tolliver |
| 4,986,016 | A | | 1/1991 | Wichman |
| 5,016,418 | A | | 5/1991 | Rhodes et al. |
| 5,701,713 | A | | 12/1997 | Silver |
| 5,822,945 | A | | 10/1998 | Muller |
| 5,900,850 | A | | 5/1999 | Bailey et al. |
| 6,026,626 | A | | 2/2000 | Fisher |
| 6,076,770 | A | | 6/2000 | Nygren et al. |
| 6,149,021 | A | | 11/2000 | Beaulieu |
| 6,219,009 | B1 | | 4/2001 | Shipley et al. |
| 6,219,974 | B1 | | 4/2001 | Hoberman |
| 6,233,881 | B1 | | 5/2001 | Rainbolt |

(Continued)

FOREIGN PATENT DOCUMENTS

| | | |
|---|---|---|
| WO | WO 00/53861 | 9/2000 |

OTHER PUBLICATIONS

European Search Report for 03 01 4246.

*Primary Examiner*—Basil Katcheves
(74) *Attorney, Agent, or Firm*—Altera Law Group, LLC

(57) ABSTRACT

A foldable truss member suitable for commercial displays includes a plurality of side members that are adjacently hinged together. The side members include support members and bridging members having extensions. The side members are joined into a foldable structure with a hinge member between the support member and extensions of adjacent side members. The truss includes latching features that hold the truss member in a deployed configuration. A display structure can be formed by connecting a locking frame between two truss members.

11 Claims, 10 Drawing Sheets

U.S. PATENT DOCUMENTS 6,240,940 B1 6/2001 Carter
6,244,010 B1 6/2001 Sluiter
6,253,520 B1 7/2001 Houk
6,260,327 B1 7/2001 Pellock
6,266,030 B1 7/2001 Warren et al.
6,276,095 B1 8/2001 Tripsianes
6,276,521 B1 8/2001 Arndt et al.
6,283,136 B1 9/2001 Chen
6,293,500 B1 9/2001 Bigelow
6,296,077 B1 10/2001 Wood et al.
6,296,109 B1 10/2001 Nohl
6,715,255 B2 4/2004 Schipani et al.

* cited by examiner

FOLDABLE SUPPORT STRUCTURE WITH LOCKING WALL MEMBERS AND HINGE LOCKS

CROSS REFERENCE TO RELATED APPLICATION

This is a continuation-in-part of non-provisional application Ser. No. 10/186,285, filed Jun. 28, 2002, now U.S. Pat. No. 6,715,255, which is incorporated herein by reference thereto in its entirety, as though fully set forth herein.

BACKGROUND OF THE INVENTION

1. Field of the Invention

The present invention relates to portable support structures for use in temporary fixtures such as trade shows and conventions, and particularly to a portable folding truss system having hinged side elements.

2. Description of Related Art

Commercial displays such as those used in trade show booths require strong structures that can be easily transported and configurable in a wide variety of forms. Such structures need to be lightweight, portable, and able to be quickly set up and broken down.

Prior art solutions have utilized truss members with folding elements that utilize rigid wall members coupled with rotatable wall members. The rotatable side members allow the truss to collapse. The trusses include internal diagonal pivoting members that serve to lock the truss into an open position. Although useful in some applications, this approach has deficiencies.

Using differently designed rigid and rotatable wall members as in prior art solutions increases the inventory of piece parts needed to build the truss, thereby making the truss more complicated and expensive to manufacture. Also, the non-symmetry of the assembled structure (due to the non-rigidity of the rotatable wall members) gives such a truss non-uniform load bearing characteristics when deployed horizontally. Therefore, if the user is not careful and/or cognizant of the requirement for a certain orientation, a structure according to the prior art design might be deployed in an unsafe manner with potentially catastrophic results.

It can be seen that there is a need for a collapsible/foldable truss member that is strong, easily fabricated and assembled into a temporary or permanent structure for a commercial display or other structural application. Further, a truss member that can be configured to provide horizontal support regardless of the truss member's orientation is also needed. The present invention fulfills these and other needs, and addresses other deficiencies of prior art implementations.

SUMMARY OF THE INVENTION

To overcome the limitations in the prior art described above, and to overcome other limitations that will become apparent upon reading and understanding the present specification, the present invention discloses a portable support structure for use in a temporary or permanent display such as trade shows and conventions and stores, and particularly a portable folding truss system having locking wall members and locking hinge elements.

The present invention solves the above described problems by providing a foldable truss system including a plurality of adjacently connected side members together forming a peripheral boundary of the truss member. Each side member includes an elongated support member having a side surface and a bridging member fixedly connected to the side surface of the support member at an attachment point of the support member. The bridging member having an extension at an edge of the bridging member opposite the attachment point. The side members also include a plurality of hinge members pivotally joining the extension of each side member to the support member of the adjacent side member, each hinge member allowing relative rotation of adjacent side members, and at least one latching member attached between two adjacent side members. The latching member preventing relative rotation of adjacent side members in a deployed configuration of the truss member.

Other embodiments of a system in accordance with the principles of the invention may include alternative or optional additional aspects. One such aspect of the present invention is that each bridging member also includes a sawtooth-shaped member having a first and second set of oppositely disposed peaks. The first set of peaks attached to the attachment point of the associated support member and the extensions of each bridging member including the second set of peaks.

Another aspect of the present invention is that the latching member includes a pair of indentations engagable with the peaks of the bridging members.

Another aspect of the present invention is that the latching member also includes a support member extending past the pair of indentations so that the support member blocks over-rotation of the engaged bridging member.

Another aspect of the present invention is that the latching member is fixedly attached to one of the hinge members.

Another apparatus in accordance with the principles of the present invention includes a foldable truss member including a plurality of adjacently connected side members together forming a peripheral boundary of the truss member. Each side member including an elongated support member having a side surface and a bridging member fixedly connected to the side surface of the support member at an attachment point of the support member. The bridging member having an extension at an edge of the bridging member opposite the attachment point. The side members also includes a plurality of hinge members pivotally joining the extension of each side member to the support member of the adjacent side member. Each hinge member allowing relative rotation of adjacent side members, a plurality of edges between adjacent side members defining a plurality of corners of the truss member. The side members also include at least one latching linkage attached between a pair of the opposing corners of the truss member. The latching linkage preventing relative rotation of side members at a deployed configuration of the truss member.

Another aspect of the present invention is that the latching linkage includes a first and second portion each rotatably coupled to the opposing corners of the truss member. The latching linkage also including a pivot between the first and second portions allowing relative rotation therebetween.

Another aspect of the present invention is that the latching linkage also includes a pair of pivot bars each with a first and a second end. The first ends of the pivot bars each rotatably attached to the truss member at the opposing corners of the truss member. The latching linkage also includes a pivot latching member rotatably attached to the second end of at least one of the pivot bars. The pivot latching member preventing relative rotation between the pivot bars at a deployed configuration of the truss member.

Another aspect of the present invention is that the pivot latching member is rotatably attached to the second ends of both of the pivot bars.

Another aspect of the present invention is that the pivot latching member is rotatably attached to the second end of one of the pivot bars and the pivot latching member is fixedly attached to the second end of the other of the pivot bars.

Another aspect of the present invention is that the pivot latching member includes a body section, an elongated cavity creating an opening along a side of the body, and one or more protrusions extending into the cavity. The second ends of at least one of the pivot bars are pivotally attached within the cavity so that the one or more protrusions engage the second ends of the at least one pivot bar to prevent relative rotation of the pivot bars in a deployed configuration of the truss member.

Another aspect of the present invention is that the second ends of both of the pivot bars are pivotally attached within the cavity so that the one or more protrusions engage the second ends of both pivot bars to prevent relative rotation of the pivot bars in a deployed configuration of the truss member.

Another aspect of the present invention is that the second ends of one of the pivot bars is pivotally attached within the cavity so that the one or more protrusions engage the second end of the pivot bar to prevent relative rotation of the pivot bars in a deployed configuration of the truss member. The second end of the other pivot bar is fixedly attached to the pivot latching member.

Another apparatus in accordance with the principles of the present invention includes a foldable truss member including a plurality of side member means, each side member means including a receiving means located at a lower edge of the side member means. The side member means are adjacently arranged so that the lower edges of the adjacently arranged side member means form a closed shape having a plurality of corners. The side members means also include a plurality of hinging means connected between adjacently arranged side member means. The hinging means allowing relative rotation between adjacently arranged side member means so that the side member means are foldable into a substantially flat assembly. The side member means also including a latching means adjacent at least one of the corners of the truss member. The latching means preventing relative rotation of the side member in a deployed configuration of the truss member.

Another aspect of the present invention is that the latching means are fixedly attached to at least one of the hinging means.

Another aspect of the present invention is that the latching means are fixedly attached to at least one of the side member means. The latching means include at least one indentation engagable with the adjacent side member means.

Another apparatus in accordance with the principles of the present invention includes a foldable truss member including a plurality of side member means each including a lower edge and two side edges. The side member means adjacently arranged so that the lower edges of the adjacently arranged side member means form a closed shape. The side member means also include a plurality of hinging means connected between the side edges of the adjacently arranged side member means. The hinging means allowing relative rotation between adjacently arranged side member means so that the side member means are foldable into a substantially flat assembly. The side edges of the side member means defining a plurality of corners of the truss member. The truss member also including a linking means connected between an opposing pair of the corners of the truss member. The linking means preventing folding of the truss member in a deployed configuration of the truss member.

Another aspect of the present invention is that the linking means includes a pair of pivot bars each with a first and a second end. The first ends of the pivot bars are each rotatably attached to the truss member at the opposing corners of the truss members. The linking means also includes a pivot latching means connected to the second ends of the pivot bars. The pivot latching means preventing relative rotation of the pivot bars in the deployed configuration of the truss member.

Another aspect of the present invention is that the pivot latching means is rotatably attached to the second ends of both of the pivot bars.

Another aspect of the present invention is that the pivot latching means is rotatably attached to the second end of one of the pivot bars and the pivot latching means is fixedly attached to the second end of the other pivot bar.

A method in accordance with the principles of the present invention includes a method of assembling a truss member including adjacently coupling a plurality of side members to form a peripheral boundary for each of the truss members, each of the side members including an elongated edge pivotally attached to the adjacent side member. The method also includes relatively rotating the adjacent side members about the elongated edges to put the side members of the truss member in a deployed configuration. The method also includes further relatively rotating the adjacent side members about the elongated edges to engage a latching member connected between the elongated edges of at least two of the adjacent side members. The latching member providing a holding force to prevent further relative rotation of the side members.

Another aspect of the present invention is that the method also includes further relatively rotating the adjacent side members about the elongated edges with a folding force sufficient to overcome the holding force of the latching member and further relatively rotating the adjacent side members about the elongated edges to put the truss member in a folded configuration.

Another aspect of the present invention is that the method also includes engaging the latching member between at least two of the adjacent side members and also includes engaging an indentation of the latching member with an extension of one of the side members.

Another method in accordance with the principles of the present invention includes a method of assembling a truss member including adjacently coupling a plurality of side members to form a peripheral boundary for each of the truss members, each of the side members including an elongated edge pivotally attached to the adjacent side member. The elongated edges of the side members defining a plurality of corners of the truss member. The method also includes relatively rotating the adjacent side members about the elongated edges to put the side members of the truss member in a deployed configuration and relatively rotating a pair of pivot bars about a first end of each of the pivot bars rotatably attached to opposing corners of the truss member to engage a pivot latching member attached to a second end of each of the pivot bars. The pivot latching member providing a holding force in the deployed configuration of the truss member to prevent further relative rotation of the pivot bars.

Another aspect of the present invention is that the method also includes further relatively rotating the pivot bars about the respective first ends with a folding force sufficient to overcome the holding force of the pivot latching member and further relatively rotating the adjacent side members about the elongated edges to put the truss member in a folded configuration.

Another aspect of the present invention is that the method also includes engaging the pivot latching member attached to the second end of each of the pivot bars further comprises engaging the second end of at least on of the pivot bars with a protrusion in a cavity of the pivot latching member.

The foregoing objects, advantages and distinctions of the invention, among others, are obtained in a presently preferred construction that provides a portable foldable truss system having locking wall members and locking hinge elements.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described specific examples of an apparatus in accordance with the invention.

BRIEF DESCRIPTION OF THE DRAWINGS

Referring now to the drawings in which like reference numbers represent corresponding parts throughout.

Figure 1:
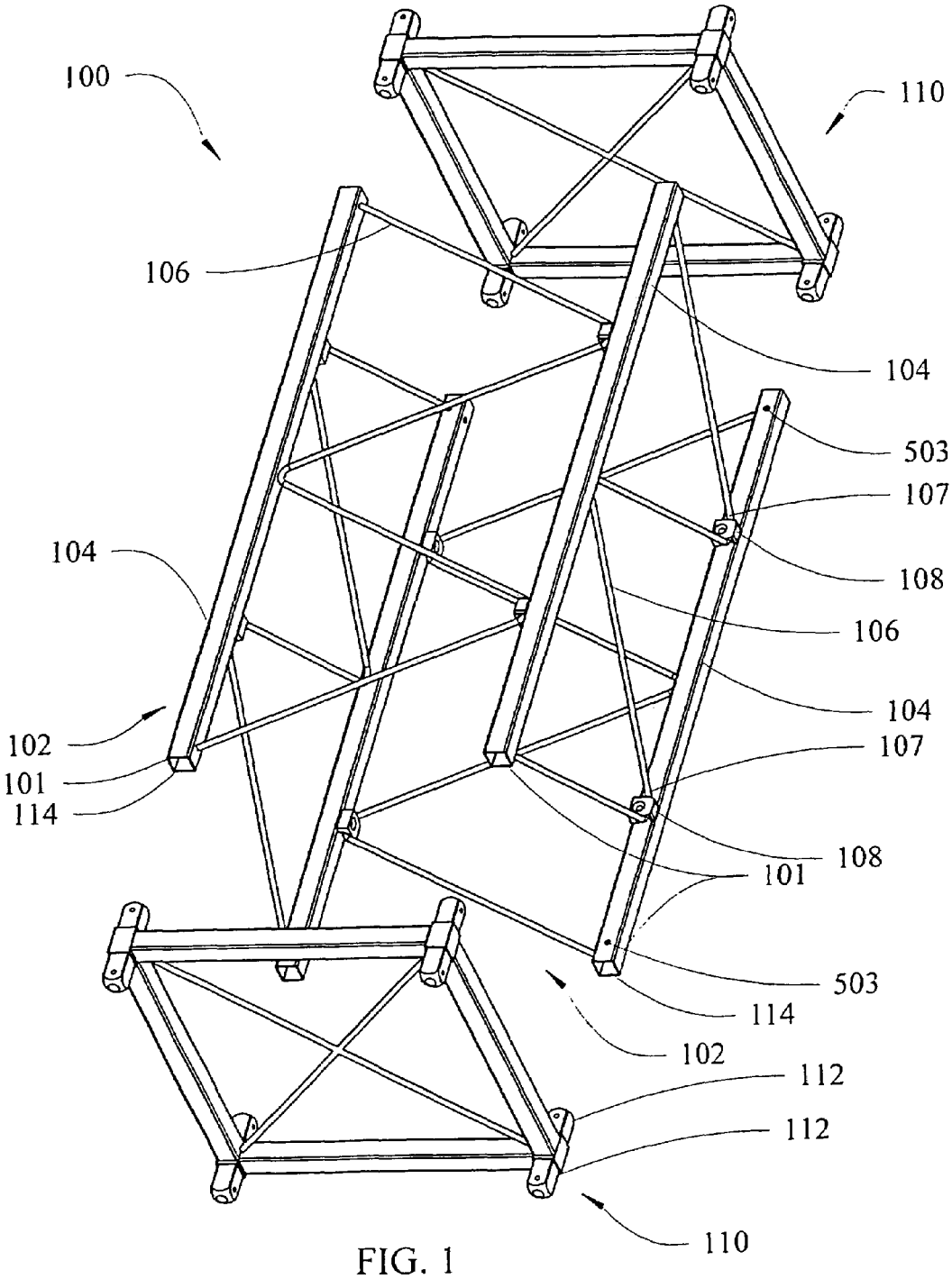
FIG. 1 illustrates a perspective view of a foldable truss according to an embodiment of the present invention.

While the invention is amenable to various modifications and alternative forms, specifics thereof have been shown by way of example in the drawings and will be described in detail herein. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF THE INVENTION

In the following description of the illustrated embodiments, references is made to the accompanying drawings which form a part hereof, and in which is shown by way of illustration, various embodiments in which the invention may be practiced. It is to be understood that other embodiments may be utilized, and structural and functional changes may be made without departing from the scope of the present invention.

The present invention discloses a portable support structure for use in a temporary or permanent display such as trade shows and conventions and stores, and particularly a portable folding truss system having locking wall members and locking hinge elements.

FIG. 1 illustrates a perspective view of a foldable truss according to an embodiment of the present invention. In FIG. 1, a truss member 100 includes a plurality of side members 102. The side members 102 are adjacently connected to form a peripheral boundary of the truss member 100 such that the lower edges 101 of the side members 102 form a closed shape such as a rectangle or a square. The side members 102 include a support member 104 and a bridging member 106. The bridging members 106 are formed of a continuous length of tubular material formed into a generally planar sawtooth or V-shape. The bridging members 106 include one or more extensions 107 located at an edge opposite where the bridging members 106 join the support members 104. The extensions 107 are located at distal angular corners of the sawtooth shape. The truss member 100 is formed by joining multiple side members 102 using a plurality of hinge members 108.

The hinge members 108, shown in FIG. 1, are fixed to one support members 104 and pivotally join the bridging member 106 to an adjacent support member 104. The hinge members 108 allow relative rotation of adjacent side members 102 while preventing the adjacent side members 102 from separating. As illustrated in FIG. 1, the truss member 100 contains four, pivotable, side members 102, thereby allowing the truss member 100 to be folded substantially flat for storage and shipment.

The hinge members 108 can be configured to hold the truss member 100 in a deployed configuration. In a deployed configuration, the side members 102 are rotated to an orientation so that the truss member 100 takes on the shape desired for the intended installation. Typically, this shape is a rectangle or square (as exemplified in FIG. 1) although it may be desired to make the deployed shape a parallelogram, triangle, or other polygon. The hinge member 108 may include locking or frictional features that retain the side members 102 in position once the side members 102 are oriented in the deployed configuration. Details of the locking and/or frictional features of the hinge members 108 will be described at a later point herein below.

The foldable truss member 100 may also be made to form a rigid support structure through use of a locking frame 110 or by other means such as cross member braces detailed elsewhere herein. The locking frame 110 is a rigid assembly with locking members 112 that interface with two or more support members 104 of the truss member 100 in a deployed configuration. The example shown in FIG. 1 shows a square or rectangular locking frame 110 with a locking member 112 at each corner.

The locking members 112 interface with receiving ends 114 of the support members 104. The locking members 112 are inserted into the receiving ends 114 to retain the truss member 100 in the deployed orientation. The receiving ends 114 may be formed as recesses or open ends of the support members 104. The locking members 112 typically extend from a top and bottom side of the locking frame 110, enabling multiple truss members 100 to be assembled end-to-end into a rigid support structure.

It is appreciated that alternate forms of a locking frame 110 can be used with a truss member 100 according to the present invention. Alternate structural elements known in the art can used to couple two or more side members 102 to make the truss member 100 rigid. For example, the locking frame 110 can be fabricated of a plate material having protruding locking members 112, or as a bar with two locking members 112 at each end. The locking members 112 can be made to encompass the receiving ends 114 and thereby allow the use of solid support members 104.

Figure 2:
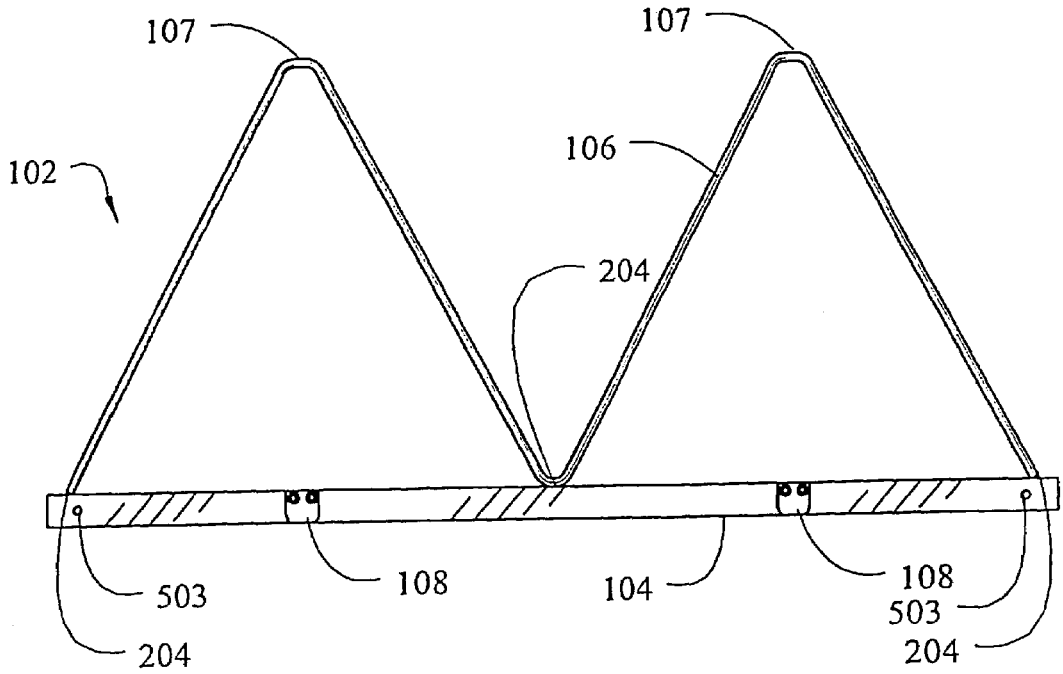
FIG. 2 illustrates a side view of a side member according to an embodiment of the present invention.

Turning now to FIG. 2, a side view of an embodiment of a side member 102 is shown. The truss member 100 is formed by adjacently connecting a plurality of side members 102 to form the outer walls of the truss member. Note that the side members 102 may be made substantially identical. Not only does this reduce the number of fabricated parts required to manufacture the truss member 100, it is also appreciated that a truss member 100 utilizing substantially identical side members will have symmetric transverse load characteristics (i.e. loads that are perpendicular to the longitudinal axis of the truss member). This makes such a truss member 100 ideal for horizontal installations, as there is no need for a preferred orientation of the side members 102.

The side member 102 is formed by fixedly attaching a bridging member 106 to a support member 104. The support member 104 is preferably formed from a tubular material, although it need not be hollow. Any cross-sectional shape of the support member 104 is appropriate, although a rectangular, square, or round cross sectional shape is typically the most useful. The illustrated support member 104 is formed from a square tube material.

The bridging member 106 is fixed to one side of the support member 104 at attachment points 204. The bridging member 106 can be tubular or a bar member bent into a sawtooth shape and attached (e.g. welded or clamped) to the support member 104. It is appreciated that the bridging member 106 can alternatively be formed from various elements, including a pattern cut from a sheet material or any elongated member (e.g. bar) formed into the desired shape. Further, although the bridging members 106 and other truss member components are typically made from metals (e.g. steel, aluminum, copper, brass, zinc, etc), the components can also be made alternate materials such as woods, plastics, carbon fiber, corrugated cardboard and composite materials.

The bridging member 106 includes extensions 107 that interface with hinge members 108 of an adjacent side member 102. The hinge members 108 are attached to the support member 104 at a location on the support member 104 generally in alignment with the bridging member extensions 107. The hinge members 108 are typically removably, as opposed to being permanently attached, thereby making assembly easier and allowing for assembly, disassembly, and re-assembly of the truss member 100 as desired.

Figure 3A:
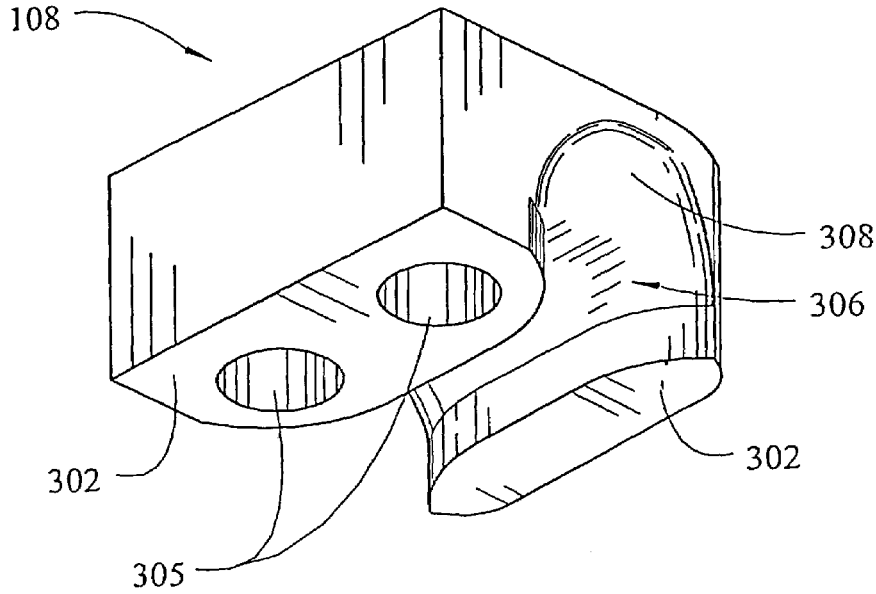
FIG. 3A illustrates a perspective view of a hinge member according to an embodiment of the present invention.

FIG. 3A shows an embodiment of an attachable hinge member 108. The hinge member 108 includes a mounting surface 302 with mounting holes 305. The mounting holes 305 align with holes on the support member 102 (not shown). The mounting holes 305 are adapted to receive fasteners, such as bolts, screws, rivets, locking pins, etc. The hinge member 108 includes a hinge channel 306 for receiving the extension 107 of a bridging member 106 therethrough. The hinge channel 306 is disposed through a portion of the mounting surface 302 and includes flared ends 308 that allow a generally curved extension 107 to freely rotate through 180 degrees within the hinge channel 306.

Figure 3B:
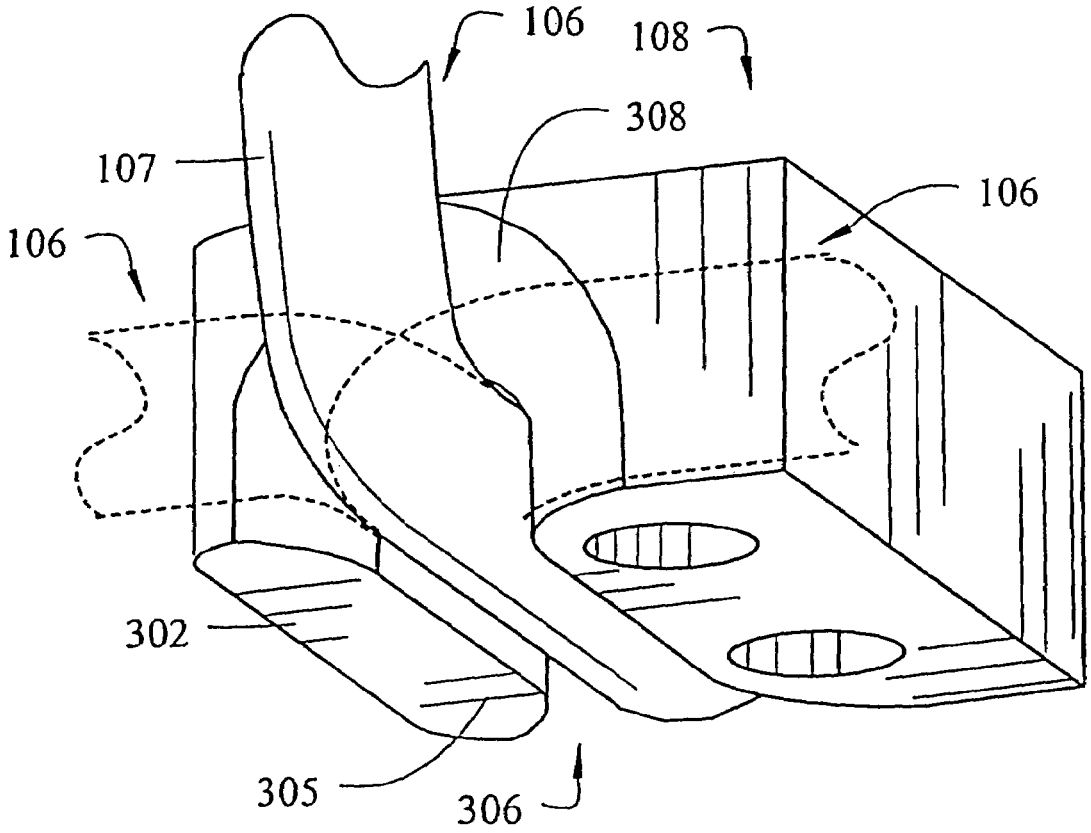
FIG. 3B illustrates a perspective view of the hinge member interacting with a bridging member extension according to an embodiment of the present invention.

The hinge member 108 may include features that allow the truss member 100 to maintain its deployed configuration during installation. These features are detailed in FIGS. 3B and 3C. In FIG. 3B, a portion of a bridging member 106 is shown in solid line with the extension 107 located within the hinge channel 306 oriented in a typical deployed configuration of the truss member 100. The orientations of the bridging member 106 corresponding to the folded configurations of the truss member 100 are shown using broken lines. Between the orientations illustrated are intermediate configurations, where the bridging member 106 is located when truss member 100 is being folded or deployed. In one embodiment, the hinge member 108 includes features that hold the extension 107 in a deployed configuration by using either friction and/or elastic deformation of the extension 107 to resist rotation of the bridging member 106.

Figure 3C:
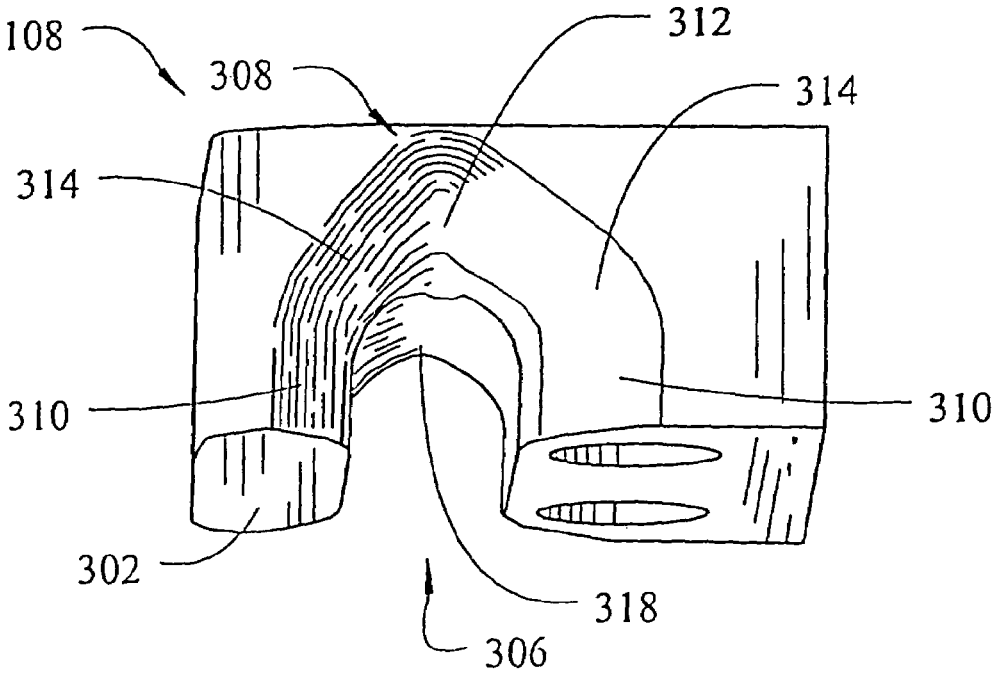
FIG. 3C illustrates a perspective view of an alternate hinge member illustrating locking features according to an embodiment of the present invention.

An example of hinge features that resist rotation of the bridging member 106 are shown in FIG. 3C. In FIG. 3C, the flared end 308 of the hinge channel 306 includes three portions of differing geometry. These portions include one or more terminal portions 310, a center portion 312 and one or more intermediate portions 314. These portions 310, 312, 314 correspond to the orientation of the extension 107 within the hinge member 106 when the truss member 100 is in the folded, deployed, and intermediate configurations, respectively. The terminal portions 310 are designed to offer little or no interference with the extension 107, thereby allowing easy rotation of side members 102 in the folded configuration. The intermediate portions 314 offer varying resistance where the intermediate portions 314 are adjacent the center portion 312. The center portion 312 typically offers some resistance to rotation of the extension 107, although preferably less resistance than the intermediate portions 314. Having less resistance at the center portion 312 gives the user feedback that the truss member 100 has attained the deployed configuration, because the extensions 107 will "snap" into the center portion 312.

The portions 310, 312, 314 of the hinge member 108 can offer changing resistance to rotation of the extension by various means. In the example of FIG. 3C, the portions 310, 312, and 314 are formed by fillets or small grooves that form the hinge channel 308. It is appreciated that forming a fillet radius different than the inner bend radius of the extension 107 will cause the fillets to ride or rub (frictionally interfere) at contact points against portions of the extension 107. Also, the portions 310, 312, 314 of the hinge member 108 are arrayed generally radially about a rounded portion 318 of the hinge channel 306. The rounded portion 318 has a substantially constant semicircular profile throughout the hinge channel 306 in order to effectively restrain the side members 102 during deployment of the truss member 100. The portions 310, 312, 314 of the hinge member 108 may have varying shapes and be located varying radial distances from the rounded portion 318 in order to increase or decrease interference with the extension 107. For example, as shown in FIG.

3C, the intermediate portions 314 are located radially closer to the rounded portion 318 than the other portions 310, 312 and are somewhat flattened, thereby giving the flared end 308 a peaked appearance. In this way, the intermediate portion 314 causes an increase in friction and/or elastic deformation of the extension 107, thereby resisting rotation of the extension 107.

Truss members 100 may be constructed that have a large number of extensions 107 along the side members 102. In this case, it may be desirable to include a mixture of hinge members 108 alternately configured according to both the configurations shown in FIG. 3A and FIG. 3C. This allows the folding action of the truss assembly 100 to be "tuned", so that holding forces are not excessive.

A truss member 100 may be assembled by locating the extensions 107 of a first side member 102 within the channels 306 of associated hinge members 108. The associated hinge members 108 are then attached to the support member 104 of a second side member 102, trapping the extensions 107 of the first side member 102 between the associated hinge members 108 and the support member 104 of the second side member 102. This process is repeated for all side members 102 so the side members 102 form a closed periphery.

Figure 4:
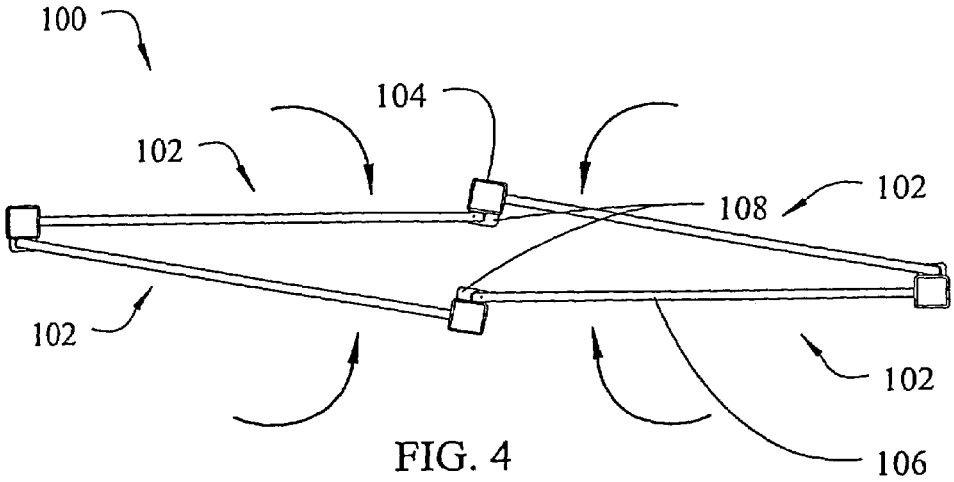
FIG. 4 illustrates an end view of the foldable truss member showing a partially folded configuration according to an embodiment of the present invention.

After assembly, the truss member 100 can be expanded for use or folded into a substantially flat folded configuration for storage or transport. FIG. 4 illustrates an end view of a partially folded truss member 100. The truss member 100 is folded by moving the side members 102 in the directions indicated by the curved arrows in FIG. 4. While being folded, the adjacent side members 102 rotate relative to each other at the edges of the side members 102 joined by the hinge members 108. Expanding the truss member 100 to the deployed configuration involves moving the side members 102 in directions opposite those indicated by the curved arrows and installing a locking frame 110 to retain the truss member in the deployed orientation.

Figure 5:
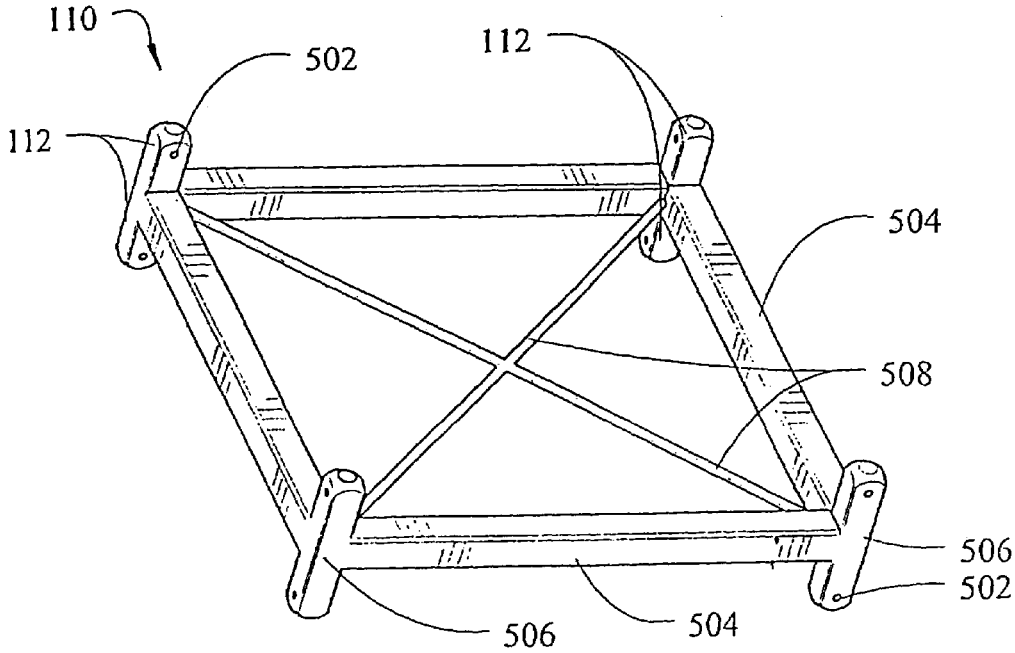
FIG. 5 illustrates a perspective view of a locking frame according to an embodiment of the present invention.

FIG. 5 shows details of the locking frame 110 used to achieve rigidity of the assembled truss member 100. The locking frame 110 in FIG. 5 is a rigid frame having four sides 504 and four corners 506. Cross bracing 508 may be included for added strength. The locking members 112 in this embodiment are formed as posts that protrude generally perpendicular to a plane defined by the four sides 504. The locking frame 100 is attached by inserting the locking members 112 of the locking frame 110 into the receiving ends 114 of the truss member 100. Locking holes 502 are included in the locking members 112. The locking holes 502 align with locking holes 503 on the support members 104 (best seen in FIGS. 1 and 2). An interference member (not shown) can be passed through holes 502, 503 to lock the truss member 100 to the locking frame 110.

Figure 6:
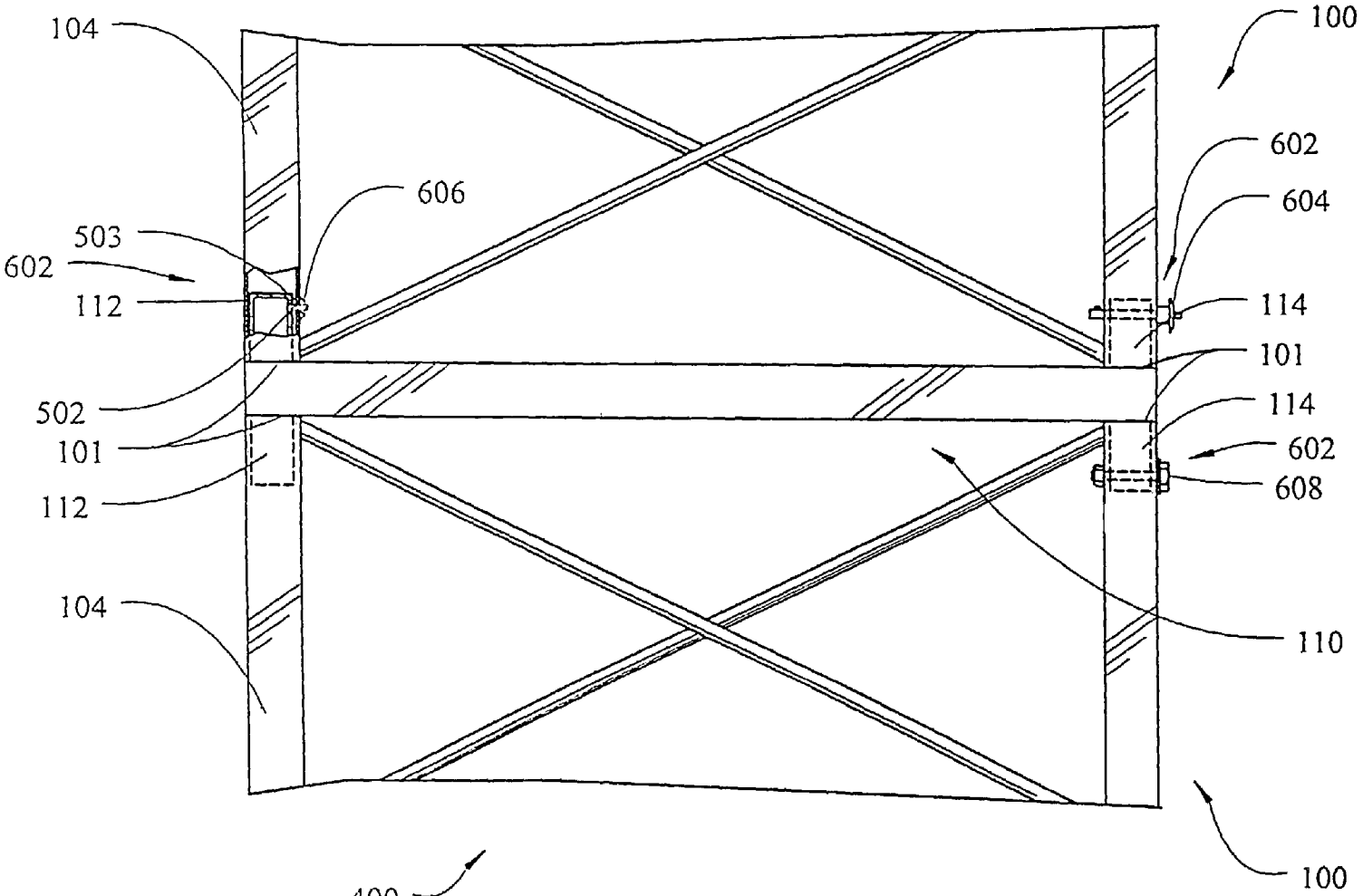
FIG. 6 illustrates a partial side view of a display structure according to an embodiment of the present invention.

FIG. 6 is a partial view of a display structure 400 created by connecting two truss members 100 to a locking frame 110. The first and second truss members 100 are expanded to the deployed configuration. The locking frame 110 is inserted into the receiving ends 114 on the lower edges 101 of the first truss members 100. The second truss member 100 is similarly attached to the locking frame 110 and thereby rigidly coupled to the first truss member 100.

A fastening member (e.g. interference member) 602 can be used to create a positive locking engagement between the locking frame 110 and the truss members 100. The mounting holes 502, 503 are aligned such that fastening members 602 can be placed through the holes 502, 503. In this example, exemplary fastening members 602 include a quick release pin 604, a welded locknut/screw assembly 606 and a nut/bolt assembly 608. Other fastening members 602 such as clips, rivets, wire ties, snaps, latches, clamps, and etc., may also be used to fasten the truss members 100 and the locking frames 110.

In some display structures 400, the truss members 100 have sufficient strength to preclude the need for a locking member 110 at every junction. At those junctions, the display structure 400 may be connected by placing independent (i.e. not interconnected) locking members 112 between the receiving ends 114. Independent locking members 112 may also be fixed with fastening members 602, as described herein above.

Figure 7:
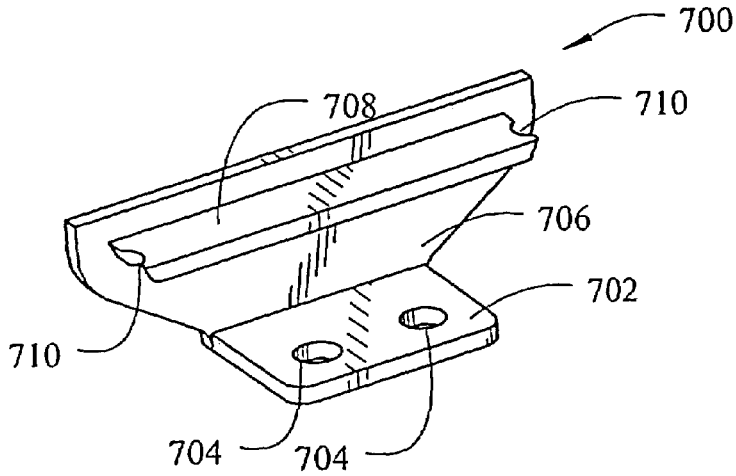
FIG. 7 illustrates a perspective view of a latching member according to an embodiment of the present invention.

In some applications, it may be desired to add a latching member to prevent relative rotation of the side members 102 in order to ensure that the truss member 100 remains in the deployed configuration (e.g. to prevent folding). In FIG. 7, an embodiment of a latching member 700 is shown. The illustrated latching member 700 is adapted to mount upon a hinge member 108, although it is appreciated that the latching member 700 may be attached anywhere at a corner between adjacent side members 102.

The latching member 700 in this embodiment includes a base section 702 with mounting holes 704. The base section 702 lies against the top surface of a hinge member 108. The mounting holes 704 align with mounting holes 305 of the hinge member 108 (best seen in FIG. 3A) and a fastener passes though both sets of mounting holes 704, 305.

Extending from the base section 702 is a support section 706. The support section 706 is typically oriented relative to the base section 702 at an angle corresponding to the angle between adjacent side members 102 in the deployed configuration. In this example (assuming a four sided truss), the support section 706 is substantially perpendicular to the base section 702.

Figure 8:
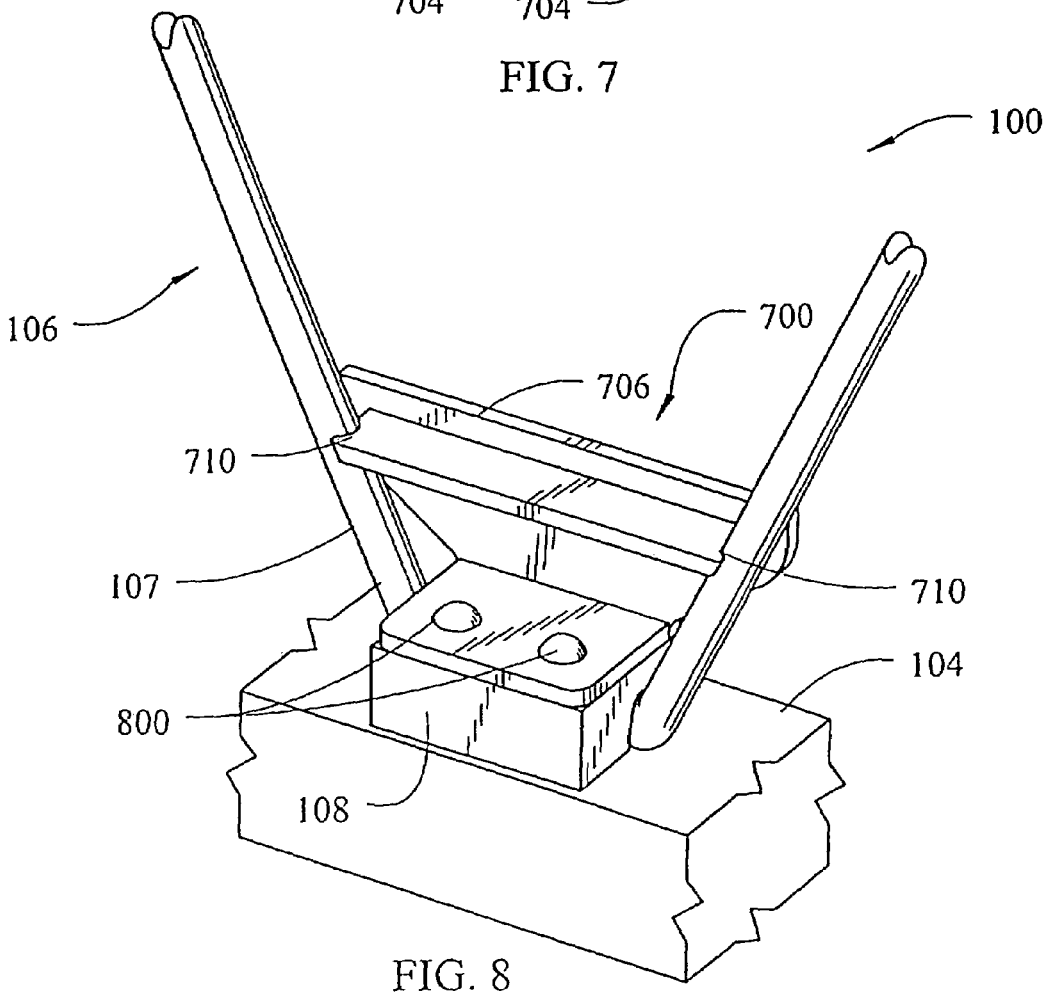
FIG. 8 illustrates a perspective view of the truss member with the latching member of FIG. 7 engaging a bridging member according to an embodiment of the present invention.

A shelf 708 extends from the support section 706. The shelf 708 has indentations 710 at either edge. The indentations 710 are formed so as to positively engage a portion of a bridging member 106 at or near the extension 107. This is seen in FIG. 8, which shows a latching member 700 of a truss member 100 in the deployed configuration in an embodiment of the present invention. The latching member 700 is fastened to the hinge member 108 and support member 104 using fasteners 800. The bridging member 106 of an adjacent side member 102 is engaged with the indentations 710 of the latching member 700, thereby preventing relative rotation between the adjacent side members 102. It is appreciated that the support section 706 extends past the indentations 710, thereby preventing over-rotation of the bridging member 106.

To fold the truss member 100 with latching members 700 retained on the hinge members 108, the user applies sufficient folding force at the corners of the truss member 100 to overcome the holding force of the indentations 710. In this way, the bridging members 106 are popped out of the indentations 710 and side members 102 can be relatively rotated to place the truss member 100 in the folded configuration. The holding force of the latching members 700 can be fine tuned by altering the indentation's shape as well as by the choice of materials used to fabricate the bridging and latching members 106, 700.

Figure 9:
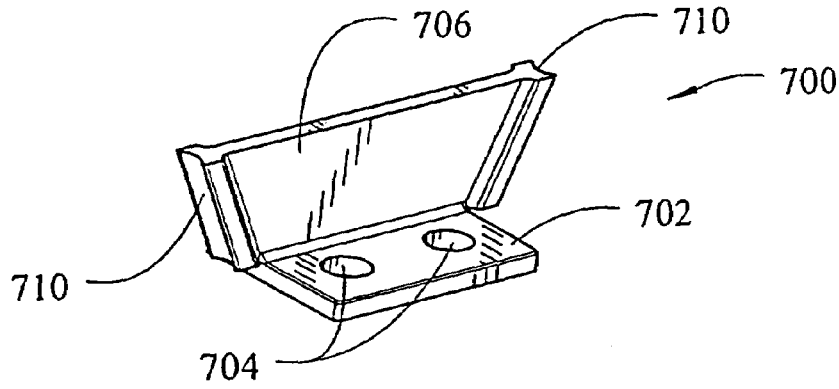
FIG. 9 illustrates a perspective view of a latching member according to an embodiment of the present invention.
Figure 10:
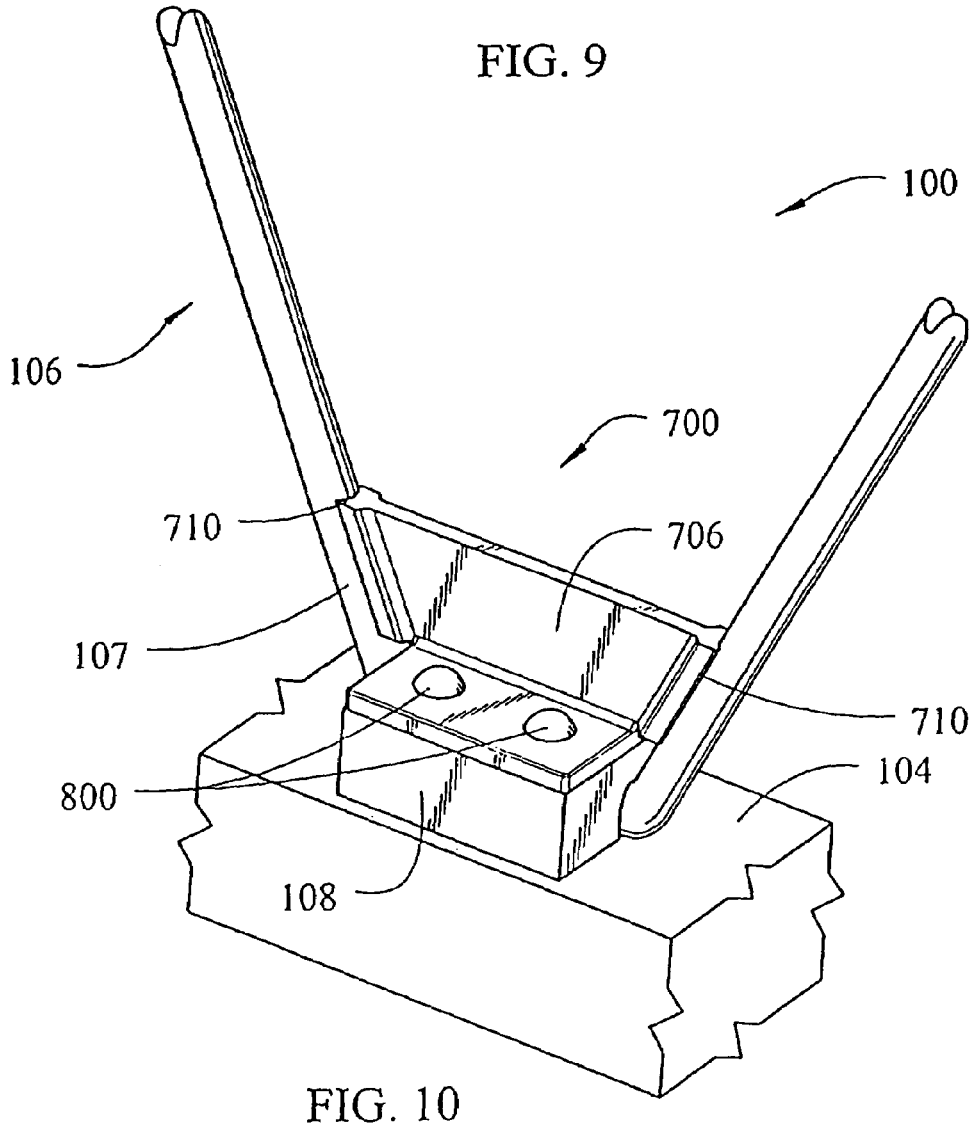
FIG. 10 illustrates a perspective view of the truss member with the latching member of FIG. 9 engaging a bridging member according to an embodiment of the present invention.

FIG. 9 shows an alternate embodiment of a latching member 700. In this embodiment, the indentations 710 are located along edges of the support section 706. The embodiment in FIG. 9 foregoes the shelf 708 seen in FIG. 7, and therefore may be easier to manufacture. As seen in FIG. 10, the indentations 710 positively engage a portion of the bridging member 106 along a length thereof. Because the support section 706 in this embodiment does not extend past the indentations 710, there is nothing preventing the over-rotation of the bridging member 106. This may be advantageous in some applications, as it allows the truss member 100 to fold in any orientation, i.e., any set of opposite corners can fold to either an acute or an obtuse angle.

Figure 11:
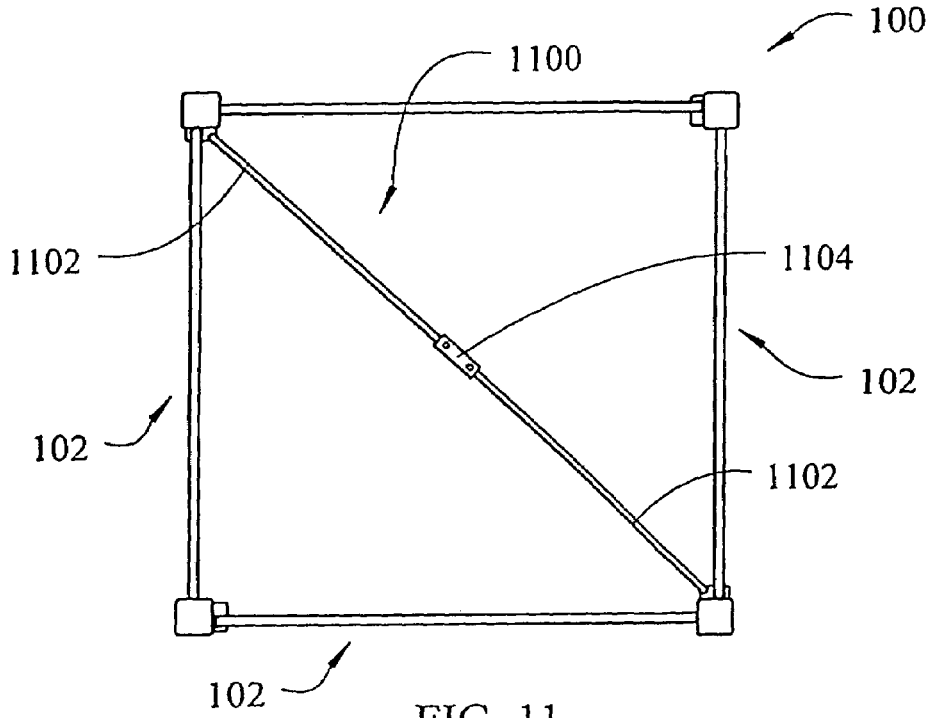
FIG. 11 illustrates an end view of the truss member in a deployed configuration with a latching linkage according to an embodiment of the present invention.

Turning now to FIG. 11, an alternate latching mechanism is shown. In this illustration, the truss member 100 is shown in the deployed configuration with a latching linkage 1100 connected between opposite corners of the truss member 100. The latching linkage 1100 prevents relative linear motion between opposing corners, thereby preventing relative rotation of the side members 102. In this embodiment, the latching linkage 100 includes pivot bars 1102 each having an end rotatably coupled to the corners of the truss member 100. In this example, the pivot bars 1102 are mounted on hinge members 108, although it is appreciated that the pivot bars 1102 can be mounted on the side members 102 at any part adjacent a truss member corner. A pivot latching member 1104 is mounted between the pivot bars 1102, and allows relative rotation therebetween.

Figure 12:
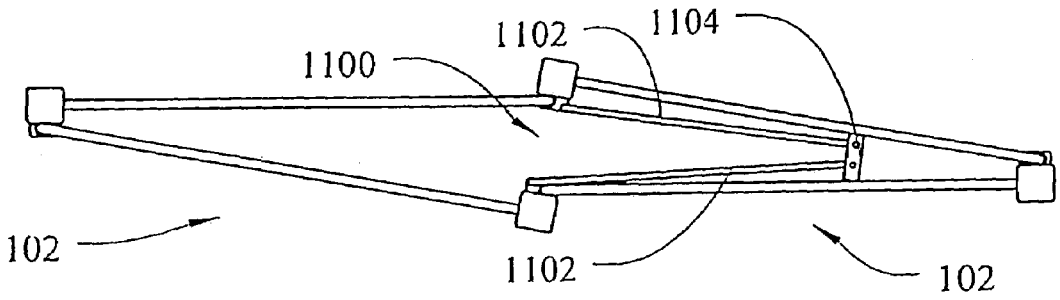
FIG. 12 illustrates an end view of the truss member in a folded configuration with a latching linkage according to an embodiment of the present invention.

In FIG. 12, the truss member 100 is shown in a folded configuration. The pivot bars 1102 are folded about the pivot latching member 1104 so that an acute angle is formed between the pivot bars 1102.

Figure 13:
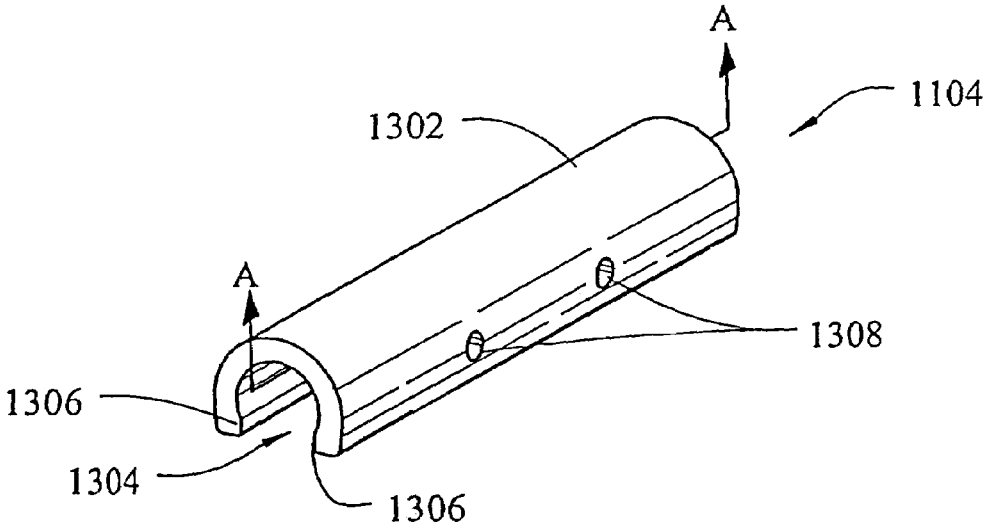
FIG. 13 illustrates a perspective view of a pivot latching member of the latching linkage according to an embodiment of the present invention.

Turning now to FIG. 13, where an embodiment of a pivot latching member 1104 is shown. The pivot latching member 1104 has a body section 1302 that is an extrusion with a generally semicircular cross section. The semi-circular shape of the body section 1302 forms an elongated cavity 1304 along the length of the pivot latching member 1104. Protrusions 1306 line the edges of the cavity 1304 and are sized to positively retain ends of the pivot bars 1102. The pivot bars 1102 are rotatably connected to the pivot latching member 1104 at pivot holes 1308.

Figure 14:
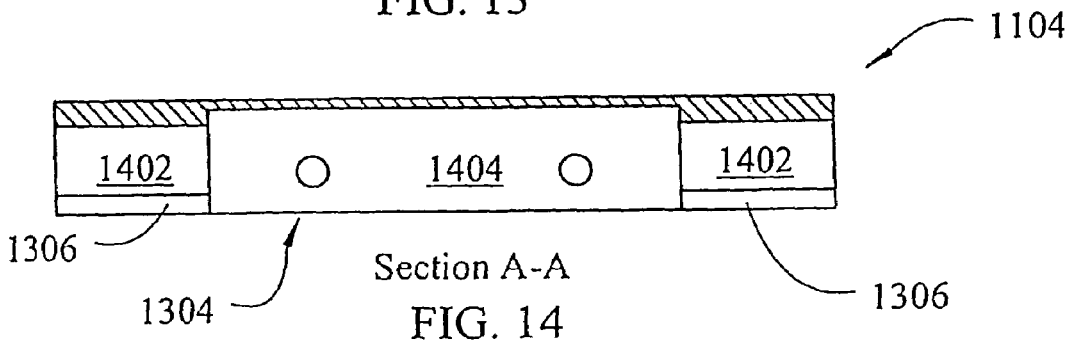
FIG. 14 illustrates a cutaway view of the pivot latching member corresponding to section A-A of FIG. 13 according to an embodiment of the present invention.

The geometry of the cavity 1304 is best seen in the cutaway view of FIG. 14. The cavity 1304 includes latching portions 1402 at either ends. The latching portions 1402 include the protrusions 1306 and are sized to positively lock onto the pivot bars 1102 in the deployed configuration of the truss member 100. An enlarged portion 1404 of the cavity 1304 is located between the latching portions. The enlarged portion 1404 allows the pivot bars 1102 to rotate freely within the pivot latching member 1104 when the truss 100 is in a folded configuration.

Figure 15:
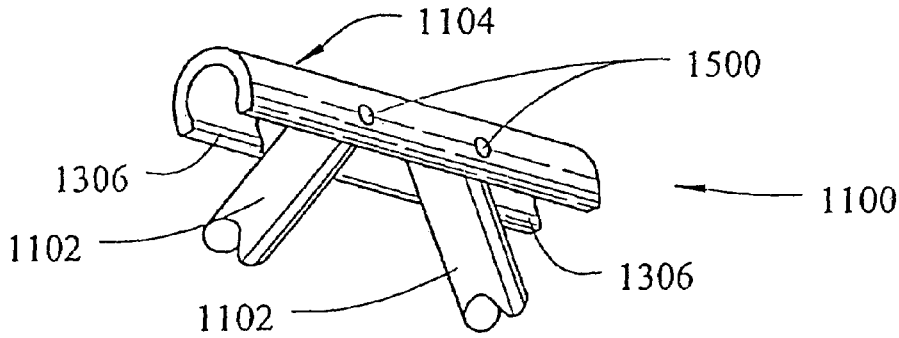
FIG. 15 illustrates a perspective view of the latching linkage according to an embodiment of the present invention.

FIG. 15 shows the latching linkage 1100 in a folded configuration of the truss member 100. Fasteners 1500 connect the pivot bars 1102 through the pivot holes 1308 to the pivot latching member 1104. In this orientation, the ends of the pivot bars 1102 are not touching the protrusions 1306, and can therefore rotate freely.

Figure 16:
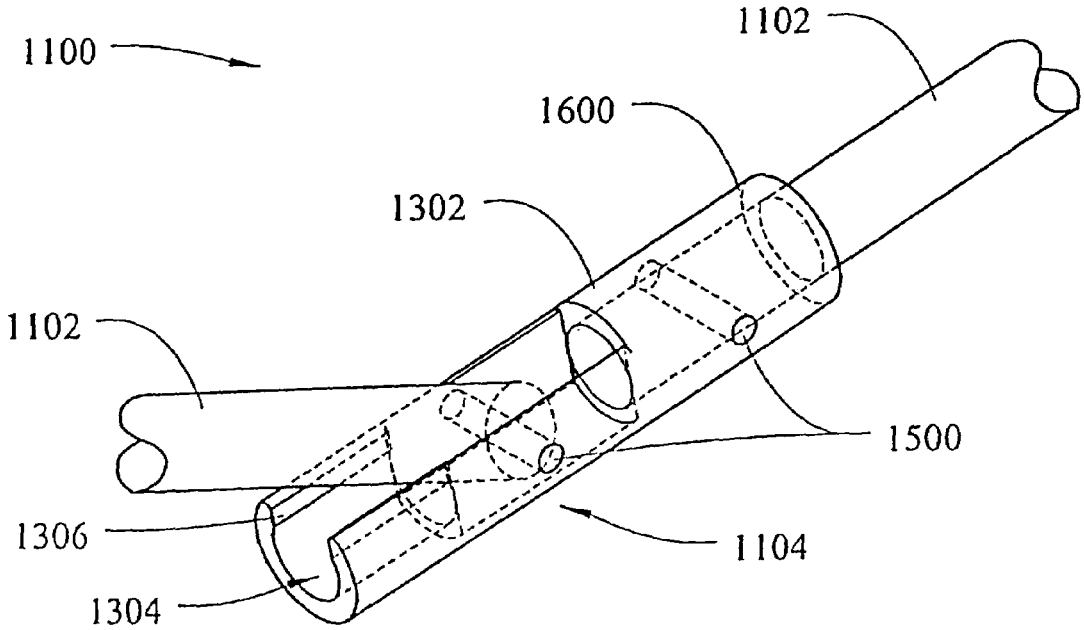
FIG. 16 illustrates a perspective view of the latching linkage according to an embodiment of the present invention.

In FIG. 16, an embodiment of the latching linkage 1100 is shown. In this embodiment, the body 1302 of the pivot latching member 1104 includes a closed cylindrical end 1600. The other end of the pivot latching member 1104 includes a cavity 1304 and protrusions 1306 similar to the embodiment shown in FIGS. 13-15. In this embodiment, one pivot bar 1102 is rotatably coupled to the pivot latching member 1104 and the other pivot bar 1102 is fixedly mounted to the pivot latching member 1104 at the cylindrical end 1600. Fasteners 1500 are used to attach both pivot bars 1102.

To deploy the truss member 100 of this configuration, the side members 102 are rotated to the deployed configuration. The pivot bars 1102 are rotated relative to each other typically by pressing on the pivot latching member 1104 until the pivot latching member 1104 engages the pivot bars 1102. The pivot latching member 1104 provides a holding force to prevent further rotation of the pivot bars 1102, and thereby prevent the truss member 100 from folding. To fold the truss member 100, a folding force is applied to the latching linkage 1100 sufficient to overcome the holding force of the pivot latching member 1104, and the pivot bars 1102 are folded inwards as the side members 102 are moved into the folded configuration.

The truss member 100 and display structure 400 according to the present invention can be beneficially be adapted for all manner of structural uses, particularly those of a temporary or seasonal nature. In particular, one such configuration desirable for uses such as displays or point of sale fixtures is described herein in detail. A truss member 100 having approximately 12"×12" cross sectional dimensions is preferable in these applications. The individual truss member lengths can vary from about 6" to about 80". The support members 102 are formed from ¾" to 1" square steel tubing welded to 3/16" wire lacing forming the bridging members 106. The hinge members 108 are investment cast from steel and finished with a smooth finish along the hinge channel surfaces 306. Fabricating the truss assembly 100 from steel offers advantages of low cost, high strength, and magnetic properties for easy attachment of magnetic graphics. The steel is typically powder coated for appearance and corrosion resistance. The support members can be of different sizes and of different materials than stated above, such as round tubes and plastics, aluminum or other materials with sufficient strength. In general, the strength of coupled truss members 100 in this specific application should be able to be safely used over a 40 foot span with no load. Loads up to a few hundred pounds can be supported either applied centrally or distributed. Such load bearing capability would enable the truss to safely support item such as computer or TV monitors, lights and signage, typically used in an exhibit/display. The weight of the truss member 100 so configured will range from ½ pound to 10 lbs for truss lengths between 6" and 80".

The foregoing objects, advantages and distinctions of the invention, among others, are obtained in a presently preferred construction that provides a portable support structures for use in temporary fixtures such as trade shows and conventions, and particularly to a portable folding truss system having hinging side elements.

The foregoing description of the exemplary embodiment of the invention has been presented for the purposes of illustration and description. It is not intended to be exhaustive or to limit the invention to the precise form disclosed. Many modifications and variations are possible in light of the above teaching. It is intended that the scope of the invention be limited not with this detailed description, but rather by the claims appended hereto.

What is claimed is:

1. A foldable truss member, comprising:

a plurality of adjacently connected side members together forming a peripheral boundary of the truss member, each side member comprising:

an elongated support member having a side surface;

a bridging member fixedly connected to the side surface of the support member at an attachment point of the support member, the bridging member having an extension at an edge of the bridging member opposite the attachment point;

a plurality of hinge members pivotally joining the extension of each side member to the support member of the adjacent side member, each hinge member allowing relative rotation of adjacent side members, a plurality of edges between adjacent side members defining a plurality of corners of the truss member; and at least one latching linkage attached between a pair of the opposing corners of the truss member, the latching linkage preventing relative rotation of side members at a deployed configuration of the truss member and wherein the latching linkage further comprises:

a pair of pivot bars each with a first and a second end, the first ends of the pivot bars each rotatably attached to the truss member at the opposing corners of the truss member; and a pivot latching member rotatably attached to the second end of at least one of the pivot bars, the pivot latching member preventing relative rotation between the pivot bars at a deployed configuration of the truss member.

2. The truss member according to claim 1, wherein the latching linkage comprises a first and second portion each rotatably coupled to the opposing corners of the truss member, the latching linkage further comprising a pivot between the first and second portions allowing relative rotation therebetween.

3. The truss member according to claim 1, wherein the pivot latching member is rotatably attached to the second ends of both of the pivot bars.

4. The truss member according to claim 1, wherein the pivot latching member is rotatably attached to the second end of one of the pivot bars and the pivot latching member is fixedly attached to the second end of the other of the pivot bars.

5. The truss member according to claim 1, wherein the pivot latching member comprises:

a body section;

an elongated cavity creating an opening along a side of the body; and one or more protrusions extending into the cavity, and wherein the second ends of at least one of the pivot bars are pivotally attached within the cavity so that the one or more protrusions engage the second ends of the at least one pivot bar to prevent relative rotation of the pivot bars in a deployed configuration of the truss member.

6. The truss member according to claim 5, wherein the second ends of both of the pivot bars are pivotally attached within the cavity so that the one or more protrusions engage the second ends of both pivot bars to prevent relative rotation of the pivot bars in a deployed configuration of the truss member.

7. The truss member according to claim 5, wherein the second ends of one of the pivot bars is pivotally attached within the cavity so that the one or more protrusions engage the second end of the pivot bar to prevent relative rotation of the pivot bars in a deployed configuration of the truss member, and wherein the second end of the other pivot bar is fixedly attached to the pivot latching member.

8. A method of assembling a truss member, comprising:

adjacently coupling a plurality of side members to form a peripheral boundary for each of the truss members, each of the side members including an elongated edge pivotally attached to the adjacent side member;

relatively rotating the adjacent side members about the elongated edges to put the side members of the truss member in a deployed configuration; and further relatively rotating the adjacent side members about the elongated edges to engage a latching member connected between the elongated edges of at least two of the adjacent side members, the latching member providing a holding force to prevent further relative rotation of the side members, said method further including relatively rotating the adjacent side members about the elongated edges with a folding force sufficient to overcome the holding force of the latching member; and further relatively rotating the adjacent side members about the elongated edges to put the truss member in a folded configuration.

9. The method according to claim 8, wherein engaging the latching member between at least two of the adjacent side members further comprises engaging an indentation of the latching member with an extension of one of the side members.

10. A method of assembling a truss member, comprising:

adjacently coupling a plurality of side members to form a peripheral boundary for each of the truss members, each of the side members including an elongated edge pivotally attached to the adjacent side member, the elongated edges of the side members defining a plurality of corners of the truss member;

relatively rotating the adjacent side members about the elongated edges to put the side members of the truss member in a deployed configuration; and relatively rotating a pair of pivot bars about a first end of each of the pivot bars rotatably attached to opposing corners of the truss member to engage a pivot latching member attached to a second end of each of the pivot bars, the pivot latching member providing a holding force in the deployed configuration of the truss member to prevent further relative rotation of the pivot bars and further relatively rotating the pivot bars about the respective first ends with a folding force sufficient to overcome the holding force of the pivot latching member; and further relatively rotating the adjacent side members about the elongated edges to put the truss member in a folded configuration.

11. A method of assembling a truss member, comprising:

adjacently coupling a plurality of side members to form a peripheral boundary for each of the truss members, each of the side members including an elongated edge pivotally attached to the adjacent side member, the elongated edges of the side members defining a plurality of corners of the truss member;

relatively rotating the adjacent side members about the elongated edges to put the side members of the truss member in a deployed configuration; and relatively rotating a pair of pivot bars about a first end of each of the pivot bars rotatably attached to opposing corners of the truss member to engage a pivot latching member attached to a second end of each of the pivot bars, the pivot latching member providing a holding force in the deployed configuration of the truss member to prevent further relative rotation of the pivot bars and wherein engaging the pivot latching member attached to the second end of each of the pivot bars further comprises engaging the second end of at least on of the pivot bars with a protrusion in a cavity of the pivot latching member.

* * * * *